United States Patent [19]

Rehbein

[11] 4,258,520

[45] Mar. 31, 1981

[54] MULTIPLE PANEL BUILDING CLOSURE

[75] Inventor: Erwin G. Rehbein, Waupaca, Wis.

[73] Assignee: Mill-Craft Housing Corporation, Waupaca, Wis.

[21] Appl. No.: 86,596

[22] Filed: Oct. 19, 1979

Related U.S. Application Data

[63] Continuation-in-part of Ser. No. 949,149, Oct. 6, 1978, abandoned, which is a continuation-in-part of Ser. No. 819,762, Jul. 28, 1977, abandoned.

[51] Int. Cl.[3] ..... E04D 1/20; E04C 1/10

[52] U.S. Cl. ..... 52/522; 52/309.16; 52/594

[58] Field of Search ..... 52/309.1, 309,16, 520, 52/521, 522, 588, 594, 543, 595

[56] References Cited

U.S. PATENT DOCUMENTS

| | | | |
|---|---|---|---|
| 3,417,531 | 12/1968 | Jones | 52/522 X |
| 3,504,467 | 4/1970 | Hatch et al. | 52/521 X |
| 3,768,846 | 10/1973 | Hensley et al. | 52/594 |
| 3,783,570 | 1/1974 | Storch | 52/520 |
| 3,866,373 | 2/1975 | Hudock | 52/309.1 |
| 3,992,839 | 11/1976 | La Borde | 52/588 |

FOREIGN PATENT DOCUMENTS

| | | | |
|---|---|---|---|
| 969460 | 6/1975 | Canada | 52/309.16 |

*Primary Examiner*—J. Karl Bell

*Attorney, Agent, or Firm*—Andrus, Sceales, Starke & Sawall

[57] ABSTRACT

A plurality of pultruded panels of high strength metal and/or glass fiber reinforced polyester resin are interlocked and sealed at their mating edges to provide an integral wall or roof closure member for a building. The member may have various configurations to provide greater self-supporting rigidity and may constitute the outside of a composite wall employing a smooth inner sheet with a rigid foamed plastic material filling the space between.

5 Claims, 7 Drawing Figures

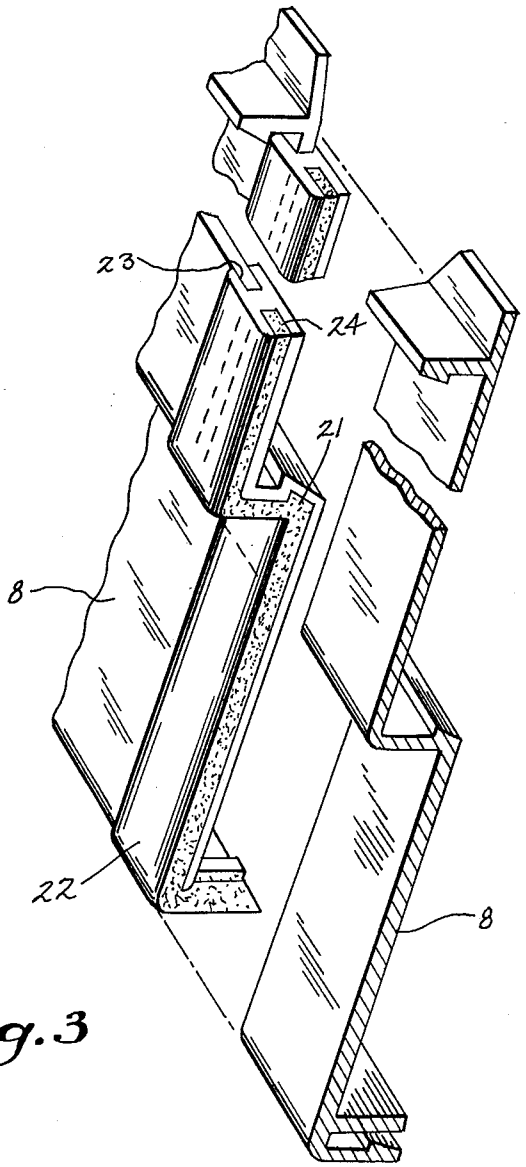
Fig. 3
Fig. 2
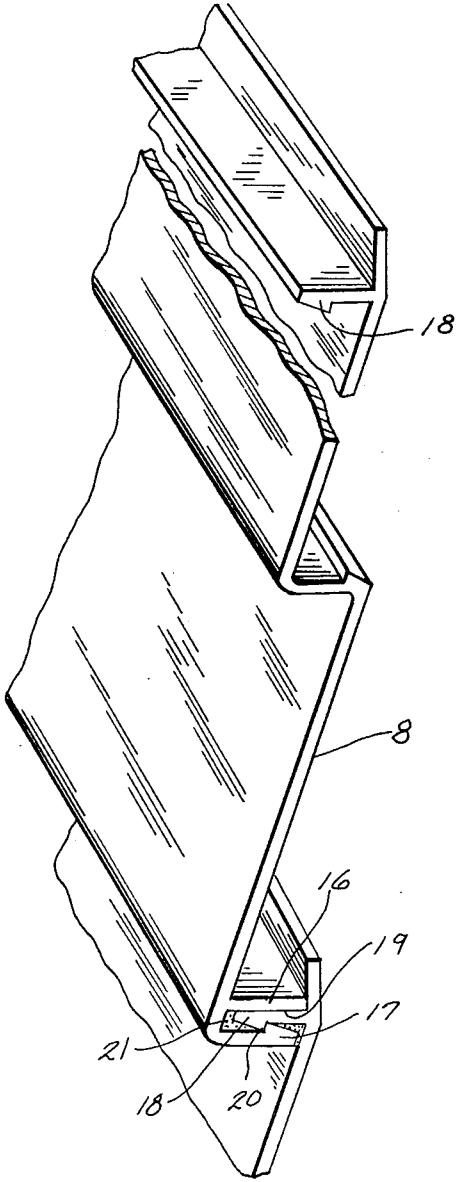

MULTIPLE PANEL BUILDING CLOSURE

This application is a continuation-in-part of application Ser. No. 949,149 filed Oct. 6, 1978 by the present inventor now abandoned, and which, in turn, was a continuation-in-part of application Ser. No. 819,762, filed July 28, 1977 now abandoned.

BACKGROUND OF THE INVENTION

This invention relates to a multiple panel building closure useful for self-supporting walls and roofs.

Most panel type wall and roof structures are not self-supporting and depend upon either some form of sheathing beneath or at least some substantial frame support. Because of the dimensional variations of such panels it is difficult to interlock them or to seal them edge to edge and obtain a desired hermetical seal that is both waterproof and of a strength comparable to the strength of the panel for support purposes.

The cutting of panels from natural wood or board products, and the molding or extruding of panels from various materials has not been conducive to the production of multiple panel closures due to the impossibility of maintaining the required dimensional tolerances for proper joinder of the panels.

Some processes of molding and/or extrusion of panels are limited to the use of materials that lack the desired strength and whereby the incorporation of reinforcing materials is impractical.

Attempts to utilize a polyester resin for panel construction as in Canadian Pat. No. 969,460 have required a sandwich type of rolled construction between cellophane carrier sheets and have tended to incorporate dimensional variation problems in the final product.

SUMMARY OF THE INVENTION

The present invention utilizes the pultrusion process for making the panels, whereby dimensional tolerances can be kept well within + or −.005" for the width of a panel and within + or −.005" for the dimensions of interlocking members and thicknesses.

By keeping the tolerances substantially within the limits specified above applicant has found that entire wall and roof closures capable of self-support, may be constructed with interlocking panel edges that do not over-stress the sealing material therein and that have very little if any tendency to warp under various stress loads.

Where a sandwich type of wall construction is desired for added insulation and/or strength an inner sheet or facing may be applied with a foamed synthetic filler between.

Various specific mounting arrangements may be employed to provide proper loading of the closure members.

BRIEF DESCRIPTION OF THE DRAWINGS

The accompanying drawings illustrate the best mode presently contemplated for carrying out the invention.

In the drawings:

FIG. 2 is a perspective view of part of two joined siding panels, each embodying a multiple clapboard shape;

FIG. 3 is a perspective view of a vertical seam between siding panels of the configuration of FIG. 1 with parts broken away and sectioned to show details;

DESCRIPTION OF THE PREFERRED EMBODIMENT

Figure 7:
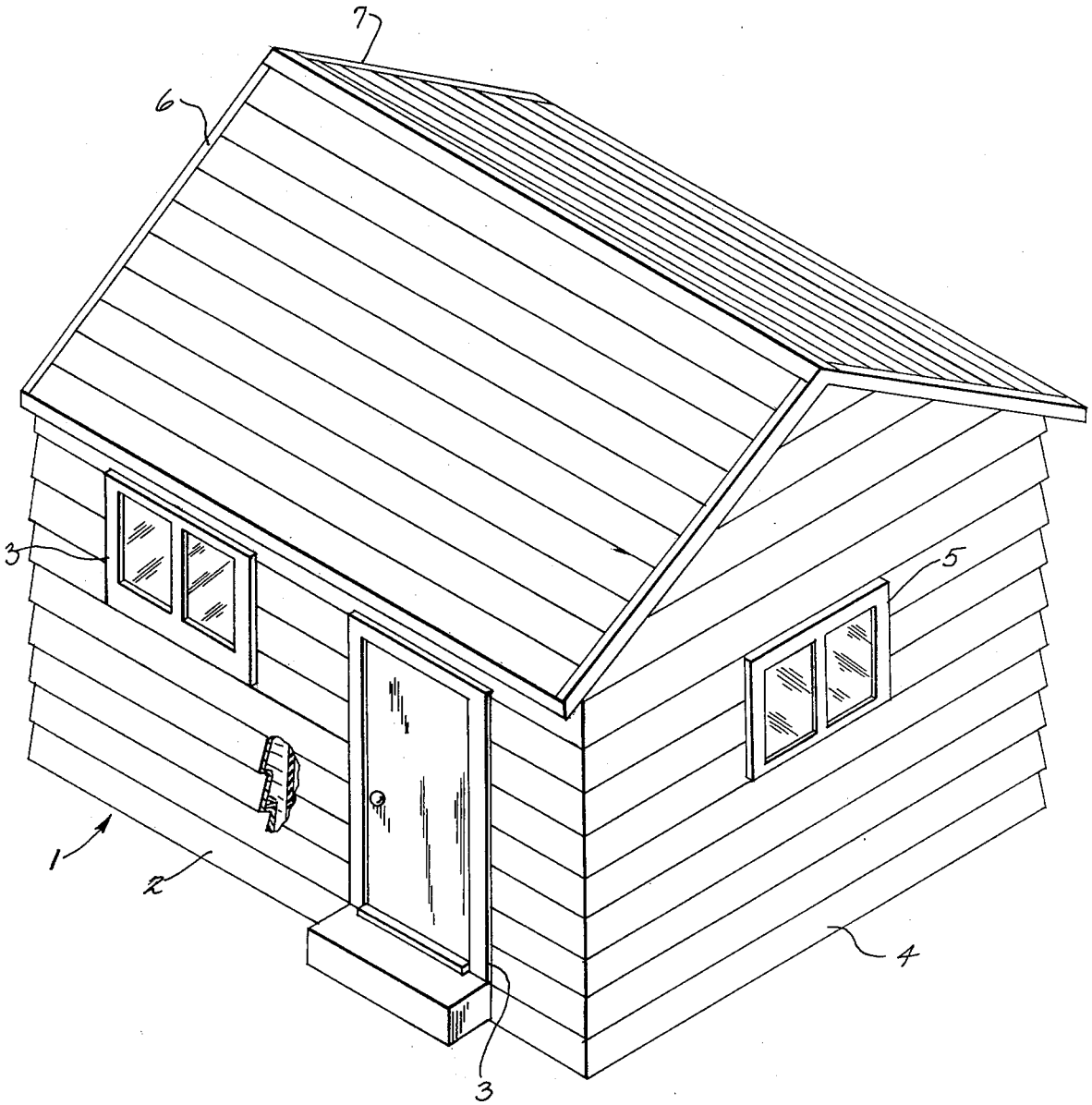
FIG. 7 is a perspective view of a building showing the walls and roofs constituting multiple panel building closures, with parts broken away and sectioned to show details of construction.

As shown in FIG. 7 a building 1 is made up of an integral front wall 2 with suitable door and window openings 3 cut and framed therein, an integral side wall 4 with suitable window openings 5 therein, and two hip roof closure members 6 and 7, each of an integral multipanel construction. The rear and other side of the building are constructed of single closure members similar to front wall 2 and side wall 4.

Each closure member 2, 4, 6 and 7 is constructed of a plurality of pultruded polyester panels 8 interlocked and sealed continuously along the mating edges thereof to provide an integral sheet or mass closure member for each wall and roof section.

Figure 1:
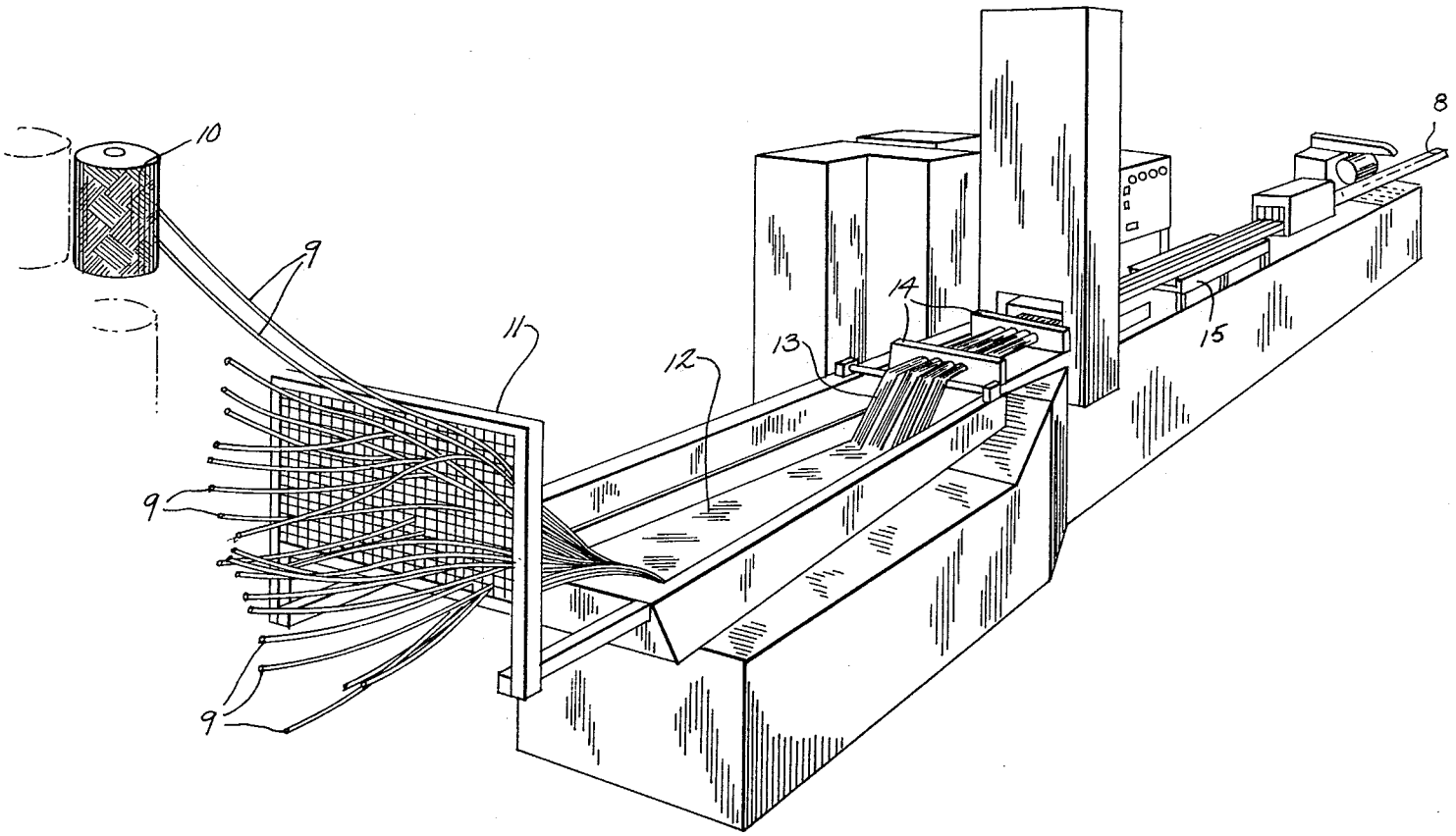
FIG. 1 is a perspective, generally schematic showing of a pultrusion machine manufacturing panels of reinforced polyester material in accordance with the invention.

As illustrated schematically in FIG. 1, the pultrusion process by which the panels 8 are made comprises generally the pulling of long cords of glass and/or metal fibers 9 from a suitable source 10 through an orienting guide stand 11, thence dipping into a bath 12 of polyester resin where the fiber picks up a resin coating.

The combined fibers and resin are continued to be pulled through straightening stands 13 and then through a heated die 14 wherein the panel 8 is cured in its desired shape.

The process may be continuous and various lengths of panels may be cut as the product emerges from the heated die 14.

One form of siding panel 8 which is a product of the pultrusion process described above is shown in FIG. 2, and has a shape simulating a plurality of clapboards extending for the full length of the panel which may be for the full length of the front wall 2 or side wall 4. The panel 8 has the same shape or configuration throughout its length. The panel 8 can be attached to the underlying structural members by inserting nails or other fasteners through the fastening flange 15.

The edge interlock for this type of panel is illustrated in FIG. 2 and comprises a double tenon-mortise joint 16 with one tenon 17 carried by the other tenon 18 at substantially right angles to each other.

The tenon 18 enters a mortise 19 which has an internal ledge 20 which interlocks with tenon 17 and is generally parallel to the plane of the panels.

The joint 16 is sealed hermetically by filling the mortises prior to assembly with an adhesive or sealant 21 which in effect embeds the tenons 17 and 18 to produce a permanent joint, generally as strong as the panel and capable of transmitting the same load.

The adhesive or sealant 21 is preferably one with a polyester or epoxy base. Other sealants such as silicone base sealants may be used.

In the event the length of the panels 8 is short of the length of the front wall 2, side wall 4 or roof section 6 or 7, two panel assemblies may be joined end to end as illustrated in FIG. 3.

In this vertical joint a double channel strip 22, generally of polyester molded construction, embraces the end edges of two panel assemblies. The opposite channels 23 and 24 in strip 22 conform in shape to the corresponding end edges to be inserted therein.

In making the assembly the channel 23 is first filled with sealant or adhesive 21 and the end edge of the corresponding panel assembly is forced into it. Then the channel 24 is filled with sealant or adhesive 21 and the end edge of the opposite panel assembly is forced into it. Thereafter the joint is cured or dried as may be required. In the resulting joint the end edges of the panel assemblies are embedded in the sealant or adhesive within the corresponding channels of strip 22, forming a rigid integral construction capable of withstanding the stresses involved in a self-supporting wall.

Figure 4:
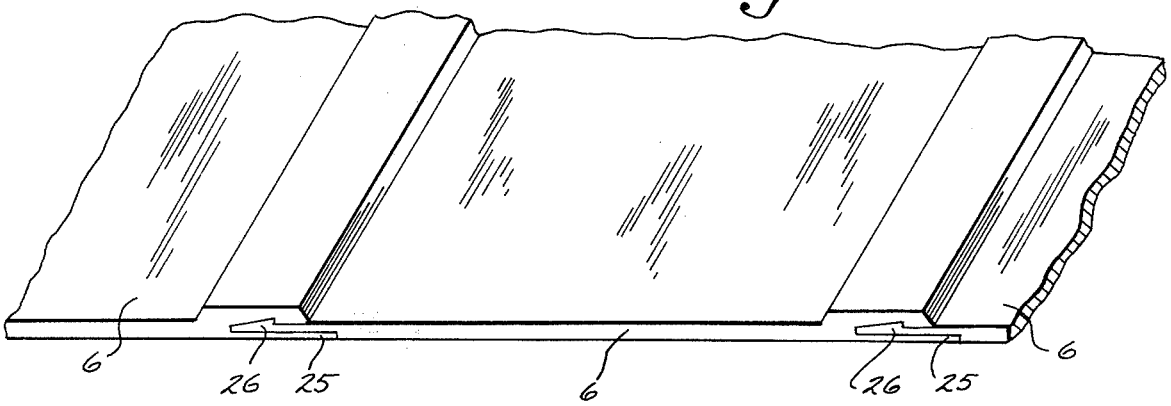
FIG. 4 is a perspective view showing an end of a flat roof panel construction.

The roof closure construction of FIG. 4 is illustrated as a self-supporting multiple panel closure 6–7 in which the panels are typically flat and interlocked and joined at their mating edges with the principle tenon 25 disposed in the general plane of the roof instead of at right angles as in FIG. 2. The design of the panel is such that it could be pultruded to any desired length to eliminate end joints and would have sufficient elasticity to be rolled up for ease of handling.

The interlocking double tenon joint 26 of the roof panels has the tenon embedded in sealant or adhesive 21 similar to the joints previously described.

Figure 5:
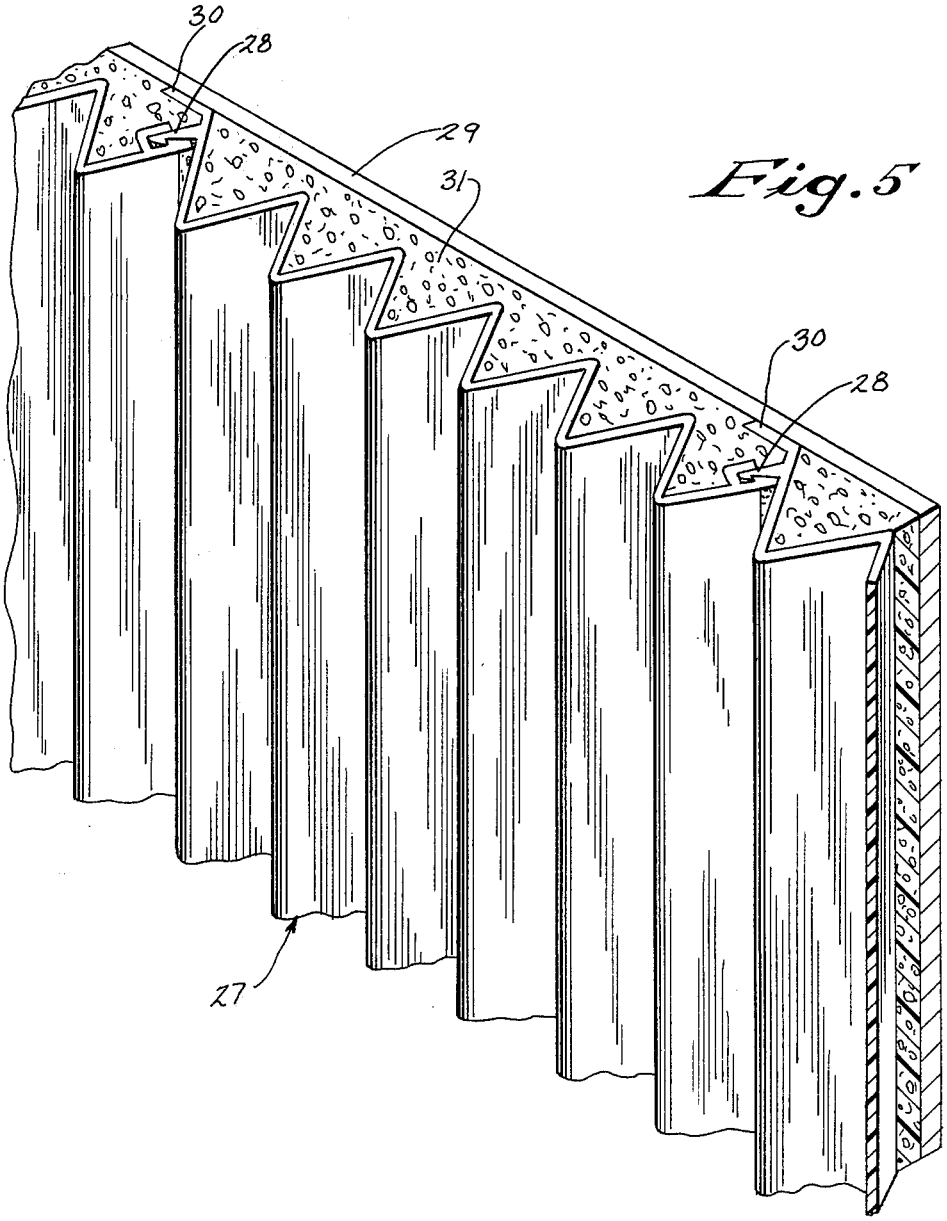
FIG. 5 is a perspective view with parts broken away and sectioned, of a multiple panel construction having reinforced ribs with an interior wall joined thereto and insulation therebetween to provide a rigid self-supporting wall.

In the wall closure illustrated in FIG. 5 the panels 27, corresponding to former panels 8, are disposed vertically with double tenon sealed joints 28 at their mating edges to provide an integral wall closure for a building. The joints 28 are similar to those previously described with respect to FIGS. 2 and 4, with the exception that they are disposed at an angle to the plane of the wall.

Each panel 27 in FIG. 5 has a saw tooth configuration to provide certain desirable strength characteristics. Smooth planar interior wall member 29 is secured to the fastening flange 30 of the panel by nails, adhesives or other fasteners, and a foamed synthetic material 31 fills the spaces between the panels 27 and the member 29 to provide a strong, rigid sandwich wall or roof closure for the outside of a building with desirable heat insulating properties.

Figure 6:
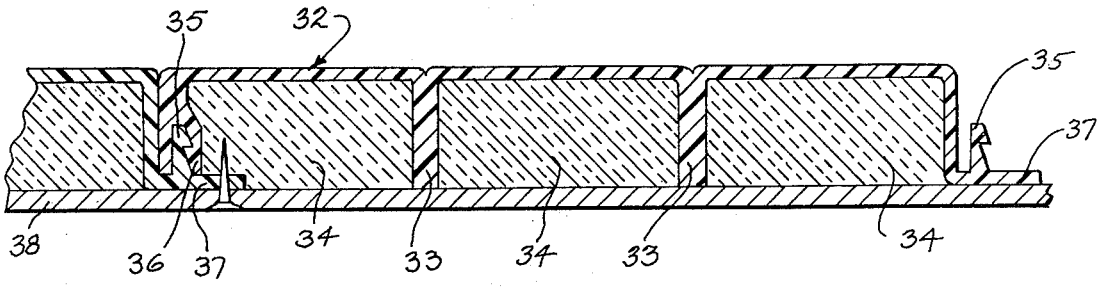
FIG. 6 is a transverse horizontal section of a self-supporting multiple panel wall structure.

FIG. 6 illustrates a modification of the construction shown in FIG. 5, and wherein the panels 32 are formed with internal ribs 33 to provide inward facing channels for receiving insulating material 34. In this construction the outside surface of the wall or roof closure is substantially planar. The panels 32 are joined together along their edges by a double tenon sealed joint formed by tenons 35 and 36, and flange 37 extends outwardly from tenon 35 in a direction parallel to the face of the panel. An interior wall member 38 can be secured to the flanges 37 by nails or other fasteners.

It has been generally difficult and economically impossible heretofore to provide multiple panel integral closure members for buildings, due largely to the inability to obtain sufficiently accurate dimensioned edge mating of cut and molded panels. By employing the pultrusion method of panel construction using a fiber reinforced thermosetting resin it is possible to provide substantial structural strength, as well as very great accuracy in joint formations and in panel dimensions so that the double tenon joints can be assembled with uniformly close fit, generally relieving the sealant or adhesive of undue load stresses.

Wherever sealants or adhesives are subjected to load stresses, as heretofore encountered with cut and molded panels, the sealants soon deteriorate and require expensive re-caulking of the joints every few years.

The present invention largely eliminates this difficulty and the rigid joints herein provided is believed to generally preserve the integrity of the sealant for many years.

It is also believed that the self-supporting character of the integral multiple panel building closures of the present invention will enable simple buildings to be constructed without frames, although numerous building regulations may prevent this ultimate realization for the present.

The building closures provided by the present invention are capable of mass manufacturing methods and provide an economic construction not heretofore generally realized for building construction.

Various modes of carrying out the invention are contemplated as being within the scope of the following claims particularly pointing out and distinctly claiming the subject matter which is regarded as the invention.

I claim:

1. A multiple panel building closure, comprising an integral wall member constructed of pultruded reinforced resin panels having accurately formed mating edges, double-mortise joints interlocking said panels together uniformly along their co-extensive mating edges, a fastening flange disposed on each panel for securing the panel to a building element, and a sealant embedding the tenons of said joints, to thereby provide a self-supporting hermetically sealed closure member generally co-extensive with a side or roof section of a building.

2. A building construction, comprising a plurality of panels each formed of pultruded reinforced thermosetting resin, a male tenon disposed adjacent one edge of each panel, a female tenon disposed adjacent an opposite edge of each panel, a male tenon of one panel being engaged with a female tenon of a second panel to provide an interlocked joint between the panels, a fastening flange disposed adjacent the male tenon and disposed at an angle with respect to said male tenon, a wall member secured to said flange, and a sealing material disposed within said joint to provide a self-supporting panel structure.

3. The construction of claim 2, wherein said male tenon includes a base portion joined to the panel and an outer portion extending generally laterally from said panel, said flange being connected to the base portion of the male tenon.

4. The construction of claim 3, wherein the flange lies in a plane generally parallel to the plane of the panel and extends at an angle of about 90° with respect to the male tenon.

5. The construction of claim 2, and including a layer of insulating material disposed between each panel and the wall member.

* * * * *

UNITED STATES PATENT AND TRADEMARK OFFICE

CERTIFICATE OF CORRECTION

PATENT NO. : 4,258,520

DATED : March 31, 1981

INVENTOR(S) : ERWIN G. REHBEIN

It is certified that error appears in the above-identified patent and that said Letters Patent are hereby corrected as shown below:

Column 4, line 35, CLAIM 1 Cancel "double-mortise" and substitute therefor ---"double tenon-mortise".

Signed and Sealed this

*Thirtieth* Day of *June 1981*

[SEAL]

*Attest:*

RENE D. TEGTMEYER

*Attesting Officer*

*Acting Commissioner of Patents and Trademarks*